US005226748A

United States Patent [19]

Bärenwald et al.

[11] Patent Number: 5,226,748

[45] Date of Patent: Jul. 13, 1993

[54] TRENCH DRAIN CHANNEL CLIP SUPPORT

[75] Inventors: Jörg R. Bärenwald, Concord Township, Lake County; August W. Haupt, Euclid, both of Ohio

[73] Assignee: Aco Polymer Products, Inc., Chardon, Ohio

[21] Appl. No.: 693,451

[22] Filed: Apr. 29, 1991

[51] Int. Cl.[5] ..... E02B 5/00

[52] U.S. Cl. ..... 405/121; 404/2; 404/4; 405/118; 405/119

[58] Field of Search ..... 405/121, 122, 123, 118, 405/119; 404/2-4, 26, 25; 52/11

[56] References Cited

U.S. PATENT DOCUMENTS

| | | | |
|---|---|---|---|
| 2,191,979 | 2/1940 | Bierbach | 52/365 X |
| 2,892,604 | 6/1959 | Keen et al. | 248/125 |
| 3,001,765 | 9/1961 | Shobert | 24/457 X |
| 3,233,297 | 2/1966 | Havener | 248/125 X |
| 3,355,895 | 12/1967 | Bayes et al. | 405/122 X |
| 3,357,143 | 12/1967 | Bayes et al. | 52/11 |
| 3,552,579 | 1/1971 | Simon | 24/336 X |
| 4,149,710 | 4/1979 | Rouchard | 405/121 X |
| 4,257,716 | 3/1981 | Woodrow | 405/118 |
| 4,878,782 | 11/1989 | Beattie et al. | 405/121 X |
| 4,908,915 | 3/1990 | Ruggles et al. | 24/336 |
| 5,000,621 | 3/1991 | Beamer | 405/118 X |

OTHER PUBLICATIONS

ACO Channel Chair Advertisement—First Published in 1985.

Polycast Information Bulletin—Jan. 25, 1990.

Polydrain catalog "Printed in USA DPM 32/Jan. 1991" pp. 1-31.

*Primary Examiner*—Dennis L. Taylor

*Attorney, Agent, or Firm*—Watts Hoffmann Fisher & Heinke

[57] ABSTRACT

A clip-type support for use in installing trench drain systems. The clip device has two clip structures spaced from each other along a central web to engage, clamp and support two inter-engaging end portions of adjacent drain channel sections. A middle portion of the clip device separating the two clip structures has two deformable tabs, each located on opposite sides of the web. The tabs have apertures for engaging support rods which support the clip and drain channel sections within a trench in which the trench drain system is being installed. By deforming the tabs, the apertures are aligned relative to the rods thereby allowing the clip to move along the rods to align the adjacent drain channel sections. When the tabs are not deformed, the apertures are not aligned thereby locking the clip in place relative to the rods.

5 Claims, 7 Drawing Sheets

TRENCH DRAIN CHANNEL CLIP SUPPORT

TECHNICAL FIELD

This invention relates to support apparatus for use in installing trench drain systems, and more specifically to a clip-type support for use in supporting and aligning two cooperating drain channel end portions during installation.

BACKGROUND

Trench drains are typically channel-shaped conduits, open at the top and covered with grates, and recessed into a surface, such as a floor or the ground, to catch liquid runoff. Trench drains are installed below the surface so that their grated tops are substantially flush with the surface to allow liquid runoff to enter the trench drain. In order to permanently install the trench drains, a trench deeper and wider than the channel-shaped conduit is dug, sections of the conduit are supported in the trench in desired alignment and height, and concrete is poured around the sides and under the channel sections forming the trench drain. It is important that the various drain channel sections be properly positioned when the concrete is poured so that the top is even with the surface and the liquid runoff will travel properly within the trench drain. Even though the drain channel sections are initially aligned, the pouring of the concrete often times causes them to move or float, thereby disrupting the drain channel section alignment.

One problem with aligning the drain channel sections stems from their method of production. The drain channel sections are cast in an inverted position. As a result, the surface of the drain channel sections that forms the outside bottom when the drain channel sections are inverted into a proper position is not particularly accurate with respect to the open top portion of the drain channel sections. Accordingly, if the drain channel sections are supported in the trench by their outside bottom surfaces, the inaccuracies of those surfaces result in top surfaces of adjacent drain channel sections that are not necessarily aligned or at the proper depth.

One previous device which has been used to support drain channel sections during installation is referred to as a Channel Chair. Channel Chairs are A-shaped devices constructed of steel wire with cross rungs to support one end of one of the drain channel section and a mating end of the next adjacent drain channel section. However, the Channel Chair is difficult to arrange in a proper location in terms of the height at which it supports the drain channel sections. The legs of the chair are embedded below the bottom surface of the trench an appropriate distance to support the channel at a desired height. The drain channel sections would then be lined up with a stretch string or the like and the height of the chairs would then be adjusted relative to the surface.

The height of the Channel Chair cross bar is hard to adjust because the chair has to be lifted relative to the holes in which the legs are pressed and if they are pressed in too far, the chair may not be stable when raised somewhat. Furthermore, the drain channel sections can lift off of the supporting cross bars when the concrete is poured. In addition, the drain channel sections are aligned with these Channel Chairs but are not connected together or to the chair in any positive manner that prevents them from separating longitudinally. Also, they are supported on the bottom surface which, as previously mentioned, does not necessarily define a consistent distance from the top surface. Because the chairs are embedded in the concrete and therefore may only be used once, the simplicity and low cost resulted in their use in spite of the shortcomings.

To reduce floating of the supported channel sections when concrete is poured, it has been common to use two pours and to provide an anchoring rib adjacent opposite ends and part way up the sides of each drain channel section end portion. These anchoring ribs are covered with a first layer of concrete that is poured while the channels are supported on the chairs or otherwise supported in a trench within the ground. The first layer sets and supports them at a proper height and then the rest of the concrete is poured up to the top edge of the channels. The first layer of concrete grips the anchoring ribs to prevent the drain channel sections from floating when the trench is filled to the top of the channels with a second pour, thereby preserving the alignment of the drain channel sections. The drain channel sections do not float when the first pour of concrete is used because the concrete is not poured to a level high enough on the drain channel sections to raise them. However, two pours of concrete are time consuming and also do not bond together well.

Devices have been developed which do not support the drain channel sections from their bottom surfaces nor do they require two separate pours of concrete. These devices utilize brackets which support the drain channel sections from the top portions of their side sections. These brackets utilize strap clips that are loosened and tightened with clamping bolts to vertical re-bars imbedded in the trench. However, these devices generally require substantial manpower for adjustment when aligning the drain channel sections.

These devices can also be used by placing the bracket under the drain channel sections and supporting them on their bottom surfaces. This is not a desirable method of support because of the problems associated with supporting the drain channel sections at their bottom surfaces and additionally, because once the concrete is poured, the brackets and all other associated hardware are embedded in the concrete and therefore can only be used once. This undercuts any substantial offsetting savings in labor costs.

Another bracket utilizes bolts which engage the outer side surfaces of the drain channel sections. This device is used with re-bar and adjusted in height with U-bolts. If it is desired to use the device more than once, the device is used from the top of the drain channel section but more than one pour of concrete is required.

DISCLOSURE OF THE INVENTION

The present invention overcomes the various problems associated with supporting and aligning two cooperating drain channel end portions during installation of trench drain systems. It provides a low-cost, simple and easy-to-manufacture and install, apparatus or clip. In it's preferred form, the clip is a one-piece device that is utilized with re-bar for supporting the clip and drain channel sections within the trench into which the trench drain system is being installed.

The one-piece clip is made of resilient sheet metal. One end portion of the clip is configured to engage and resiliently clamp the outer side surface of a male end portion of a drain channel section. An opposite end portion of the clip is configured to engage and resiliently clamp the outer side surface of a female end portion of an adjacent drain channel section. The clip thereby utilizes the outer side surfaces to support and join the two adjacent drain channel sections as opposed to utilizing the outer bottom surfaces of the sections.

The middle portion of the clip has laterally extending, deformable tabs located on opposite sides of a substantially horizontal web, which runs the entire length of the clip. The tabs have an upper portion bent in angular relation to a lower portion. Each tab portion has an aperture for engaging a re-bar that supports the clip and drain channel within the trench into which the drain system is being installed. When the tab is deformed by compressing the upper portion and lower portion together, the apertures are aligned with respect to the re-bar. When the tabs are deformed, the clips can be moved along the re-bar. This allows the adjacent drain channel sections to be aligned. When the tabs are not deformed, the resilience of the metal urges one aperture toward a non-aligned position so that the tabs grip the re-bars to maintain the alignment of the drain channel sections.

The clip device is advantageous since it engages and supports the drain channel sections at the outer side surfaces of the drain channel sections as opposed to the bottom surfaces. The clip device is easy to adjust and manipulate thereby making it easy to quickly align the drain channel sections during installation of the trench drain system.

The clip device is inexpensive and easy to manufacture thereby making it economically feasible to use the clip device, which, because it is embedded in the concrete, can only be used once. The clip is stamped from resilient sheet metal and bent to shape. The resilience of the metal provides a spring-like quality to allow deformation by and gripping of drain channels in use. In the preferred embodiment, the clip is a simple one-piece device.

Furthermore, use of the clip device reduces labor costs since the clip is quickly installed and adjusted without tools and necessitates only one pour of concrete during installation.

In its broader aspects then, the clip device has a web, first and second spaced clamp structures at opposite ends of the web and deformable tabs extending outward in opposite directions from a mid-portion of the web between the two spaced clamp structures for supporting the device on vertical rods. More specifically, the first clip structure has two spaced channel supports upstanding from opposite sides of the web and configured to conform to an outer side surface of a first of two inter-engaged end portions of adjacent drain channel sections. The second clip structure has two spaced channel supports upstanding from opposite sides of the web configured to conform to an outer side surface of a second of the two inter-engaged end portions. The tabs are located on opposite sides of the web and have at least two portions, a first of which is located over a second. Each tab portion has an aperture that receives and engages a support rod or the like. The aperture of the first tab portion is aligned with that of the second tab portion with respect to the support rod when the tab is deformed. The resiliency of the metal urges the tabs to a relationship where the apertures are not aligned. The tabs readily move along the support rods when deformed, but lock in place on the rods when not deformed.

In an alternative embodiment, the clip device has two pairs of tabs, each pair located on opposite sides of the web.

The above and other features of the invention will be better understood from the detailed description that follows, when considered in connection with the accompanying drawings.

BEST MODES FOR CARRYING OUT THE INVENTION

With reference to the drawings, two adjacent, mating drain channel sections 10 arranged to form part of a trench drain system down in a trench in the ground or a floor are supported by a clip 12 which engages substantially vertical support rods 14, typically rebar, for support within the trench. The clip 12 engages and clamps two adjacent, inter-engaging end portions 16, 18 of the drain channel sections 10. The clip 12 supports the drain channel sections 10 on the rods 14 and can be adjusted along the rods so that the end portions 16, 18 are properly aligned relative to the trench drain system. Once adjusted, the clip 12 holds the drain channel sections 10 in place while concrete is poured under and around them to permanently locate and retain the drain channel sections 10 properly in the trench.

Figure 3:
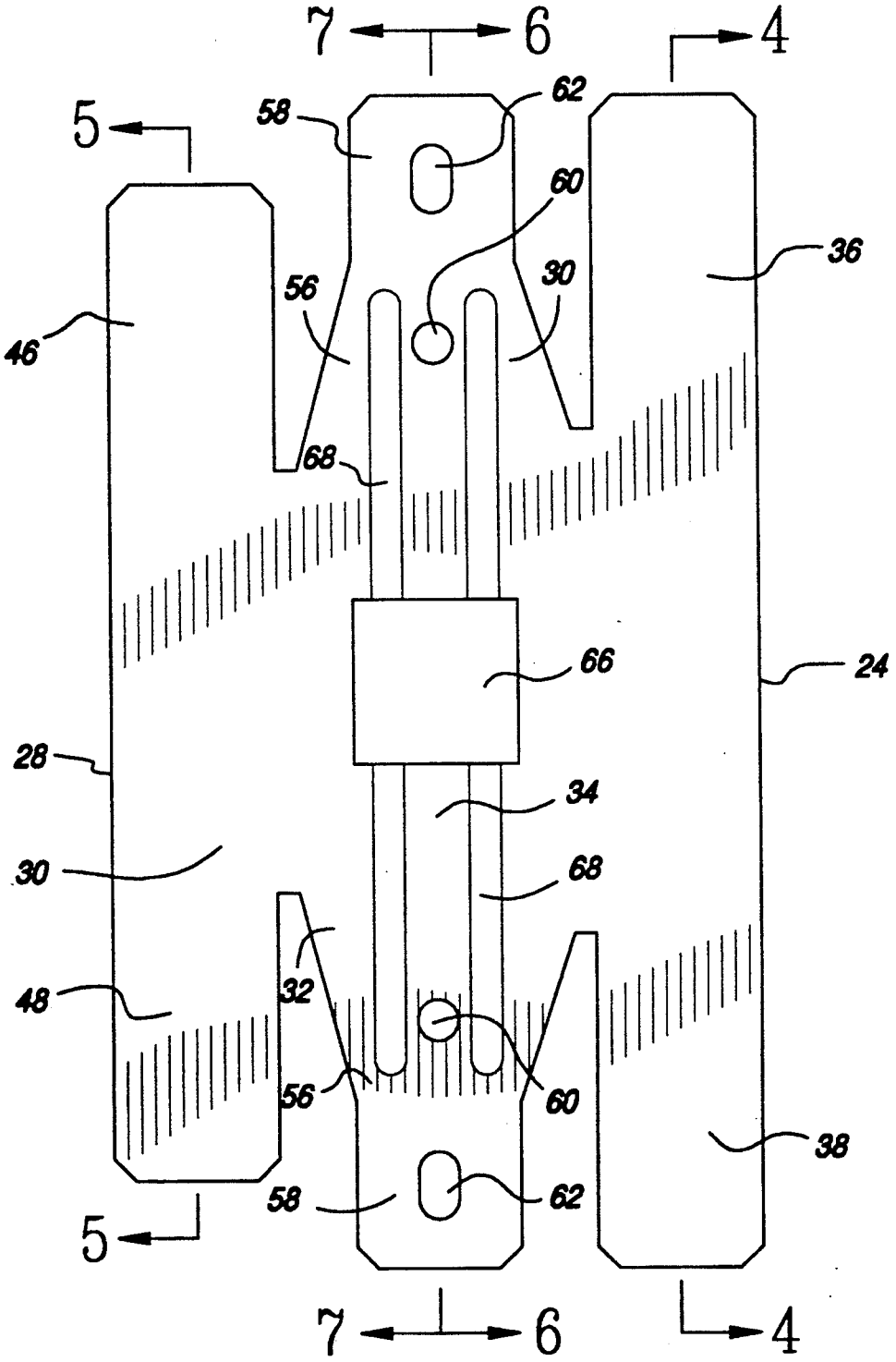
FIG. 3 is a plan view of the clip after being stamped from metal but prior to being bent into shape.

The clip 12 is shown in FIG. 3 in a blank form after being stamped from resilient sheet metal. The clip 12 is then bent to form its final shape, as shown in FIGS. 1, 2 and 4–7.

The clip 12 has a web 20, a first clip structure 22 located at a first end portion 24 and a second clip structure 26 located at a second end portion 28. Laterally extending tabs 30, 32 are located on opposite sides of a middle portion 34 of the web 20.

Figure 4:
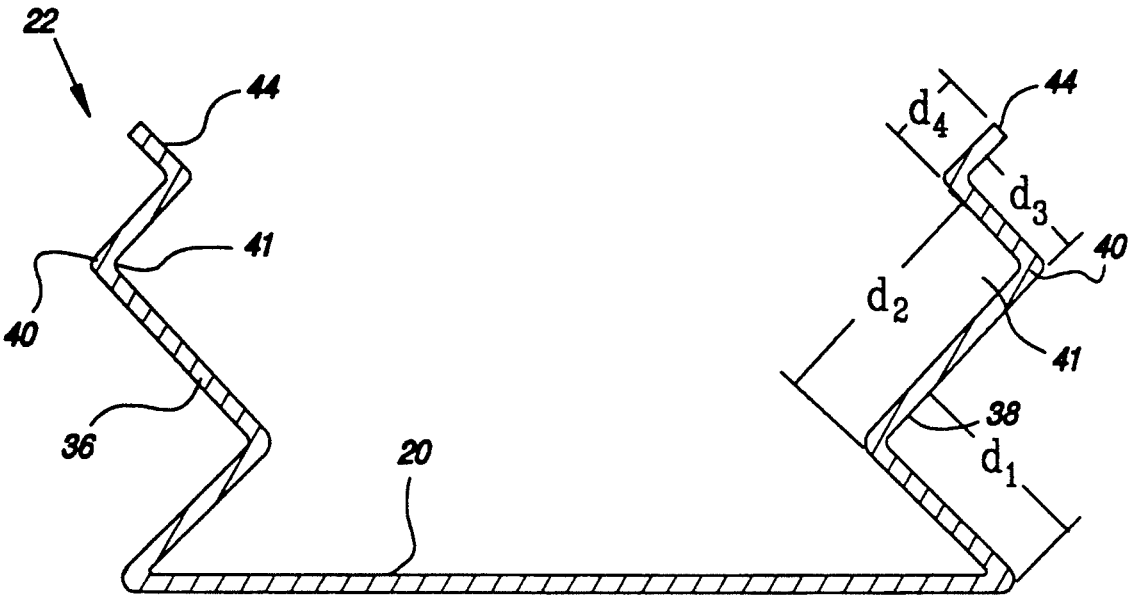
FIG. 4 is a sectional view of the clip as seen from the plane indicated by the line 4—4 of FIG. 3.

As best seen in FIG. 4, the first clip structure 22 is configured to conform to an outer side surface of a female end portion 16 of a drain channel section 10 and comprises two upstanding channel support sections 36, 38, each located on opposite sides of the web 20.

The support sections 36, 38 are mirror images of each other. The channel support sections 36, 38 have contours along the general extent that are oriented transversely of the general direction the channel support sections extend for engaging similarly oriented external side surfaces of the female end portion 16.

In the preferred embodiment, an elbow 40 on each support 36, 38 forms a recess 41 that engages an anchoring rib 42 on the outer side surface of the drain channel section 10. This allows the clip 12 to support the drain channel section 10 within the trench at the sides of the drain channel section rather than the bottom.

Both support sections 36, 38 converge with respect to each other and proceed away from the web 20 equal distances $d_1$ in planes substantially perpendicular to one another. The sections then diverge with respect to each other equal distances $d_2$ in planes substantially perpendicular to one another. The sections then converge with respect to each other equal distances $d_3$ in planes substantially perpendicular to one another and have tail portions 44 which diverge with respect to each other equal distances $d_4$ in planes substantially perpendicular to one another.

The tail portions 44 help in mounting the female end portion 16 of the drain channel section 10 within the second clip structure 22. The distances $d_1$, $d_2$ and $d_3$, as well as the width of the web 20, locate and form the elbows 40 in proper relationship to the anchoring ribs 42 of the channels to be supported.

Figure 5:
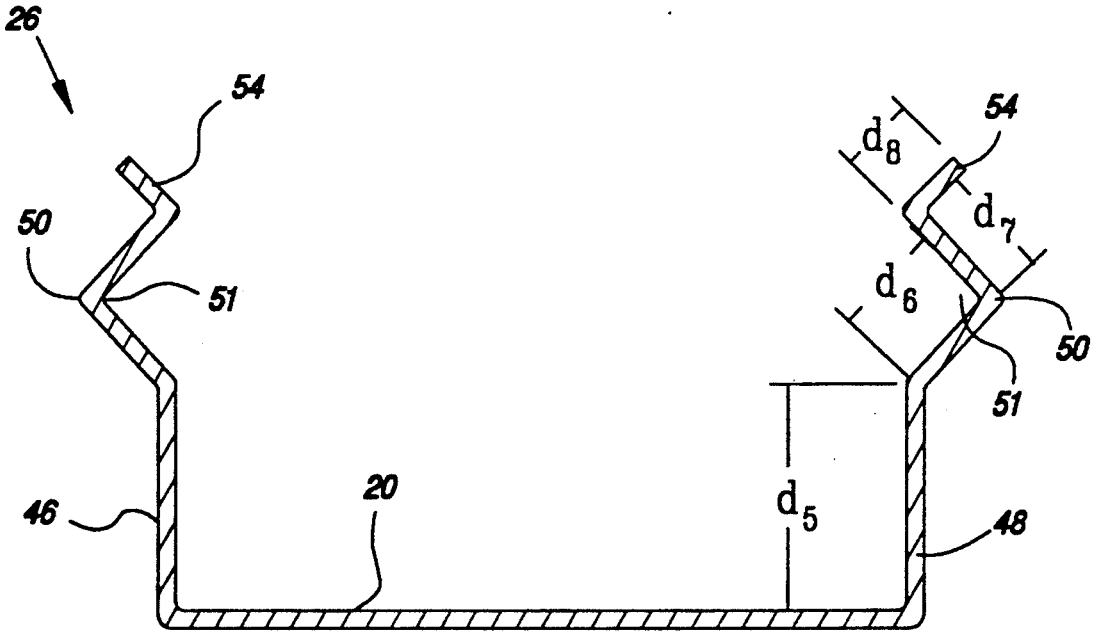
FIG. 5 is a sectional view of the clip as seen from the plane indicated by the line 5—5 of FIG. 3.

The second clip structure 26 is spaced from the first clip structure 22 by the web middle portion 34. As best seen in FIG. 5, the second clip structure 26 is configured to conform to an outer side surface of a male end portion 18 of the drain channel section 10 and comprises two upstanding channel support sections 46, 48, each located on opposite sides of the web 20.

The support sections 46, 48 are mirror images of each other. The channel support sections 46, 48 have contours along the general extent that are oriented transversely of the general direction the channel support sections extend for engaging similarly oriented external side surfaces of the male end portion 18.

In the preferred embodiment, an elbow 50 on each support 46, 48 forms a recess 51 that engages an anchoring rib 52 on the outer side surface of the drain channel section 10. This allows the clip 12 to support the drain channel section 10 within the trench at the sides of the drain channel section rather than the bottom.

Both support sections 46, 48 proceed in a common direction away from the web 12 equal distances $d_5$ in planes substantially parallel to one another. The sections then diverge with respect to each other equal distances $d_6$ in planes substantially perpendicular to one another. The sections then converge with respect to each other equal distances $d_7$ in planes substantially perpendicular to one another and have tail portions 54 which diverge with respect to each other equal distances $d_8$ in planes substantially perpendicular to one another.

The tail portions 54 help in mounting male end portion 18 of the drain channel section 10 within the second clip structure 26. The distances $d_5$, $d_6$ and $d_7$, as well as the width of the web 20, locate and form the elbows 50 in proper relationship to the anchoring ribs 52 of the channels to be supported.

Distances $d_3$ and $d_7$ are equal, as are $d_4$ and $d_8$.

The tabs 30, 32 are identical mirror image shapes, and each has two portions 56, 58. Tab portion 56 extends laterally from and in the plane of the web 20 and then tab portion 58 is bent back over tab portion 56. The tab portions 56, 58 thereby form an acute angle between them.

The tab portion 56 has a substantially circular aperture 60 for receiving a rod 14 while the tab portion 58 has a substantially elliptical aperture 62 for receiving the same rod 14. The circular aperture 60 is slightly larger in diameter than the support rod 14. The minor axis of the elliptical aperture 62 is slightly larger than the diameter of the rod 14.

If the tabs 30, 32 are deformed by compressing the tab portions 56, 58 slightly toward each other, the apertures 60 and 62 are in alignment perpendicularly to the plane of the web middle portion 34 and readily receive a rod 14. When the apertures 60, 62 are aligned, the tabs 30, 32, and thereby the clip 12, can be moved along the rods 14. This allows the clip to be vertically adjusted without tools to properly align the adjacent drain channel sections during installation of the trench drain system.

Each aperture 62 has a lip 64, which engages and grips the rod 14 when the tabs 30, 32 are not deformed. This locks the clip 12 in place with respect to the rods 14.

The middle portion 34 of the clip 12 has a large, central aperture 66. This helps assure that concrete poured during installation of the trench drain system engages the adjacent drain channel sections 10 to provide support and help secure the adjacent drain channel sections 10 in place at the female end portion 16 and male end portion 18.

Strengthening ribs 68 extending transverse to the web 20 in the middle portion 34 and extend into the tabs 30, 32. The strengthening ribs 68 help the clip 12 provide rigid support of the drain channel sections 10.

Figure 1:
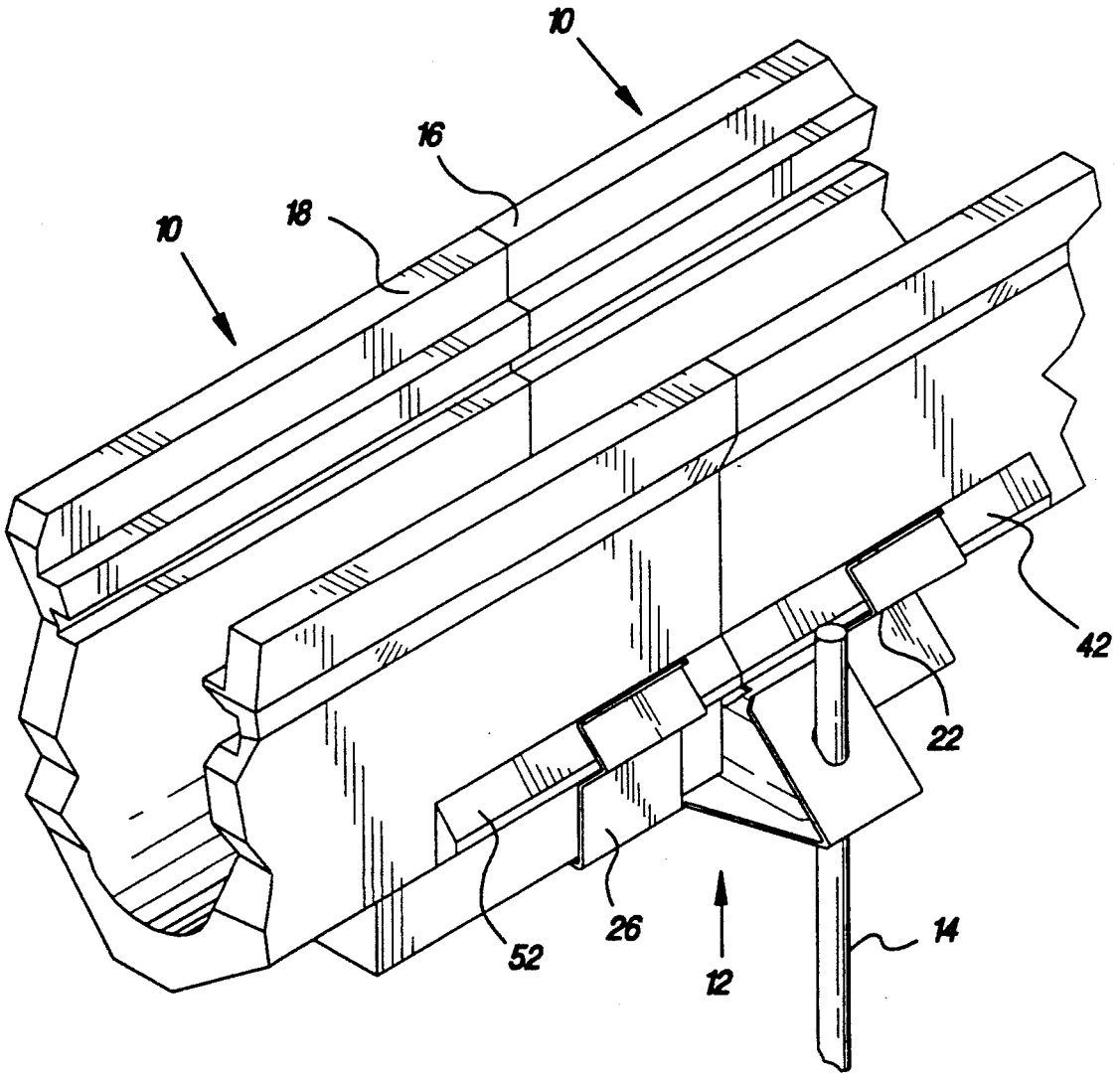
FIG. 1 is a perspective view of the preferred embodiment of the invention shown supporting two interengaging, drain channel sections.
Figure 2:
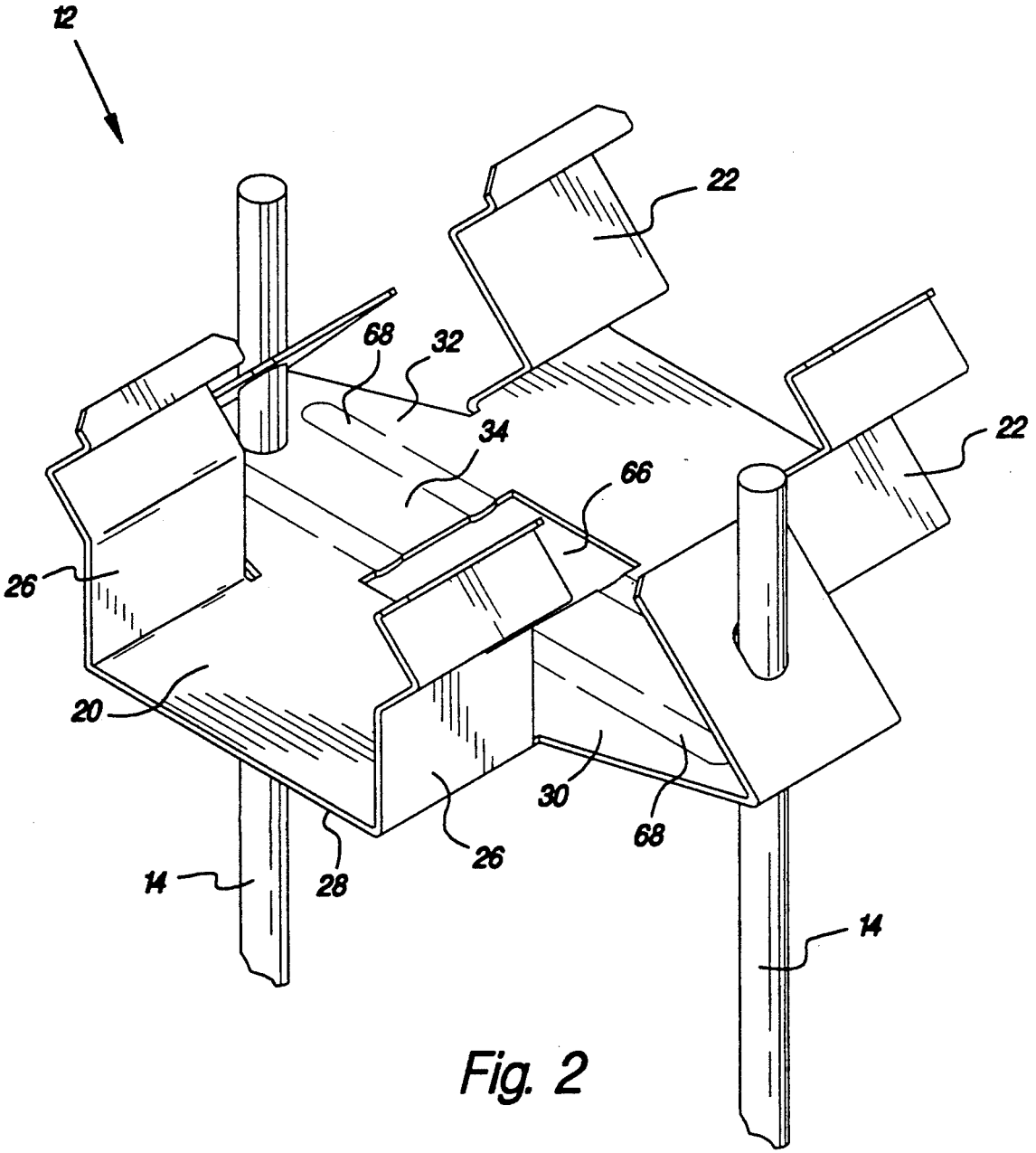
FIG. 2 is a perspective view of the preferred embodiment of the clip of the invention.
Figure 6:
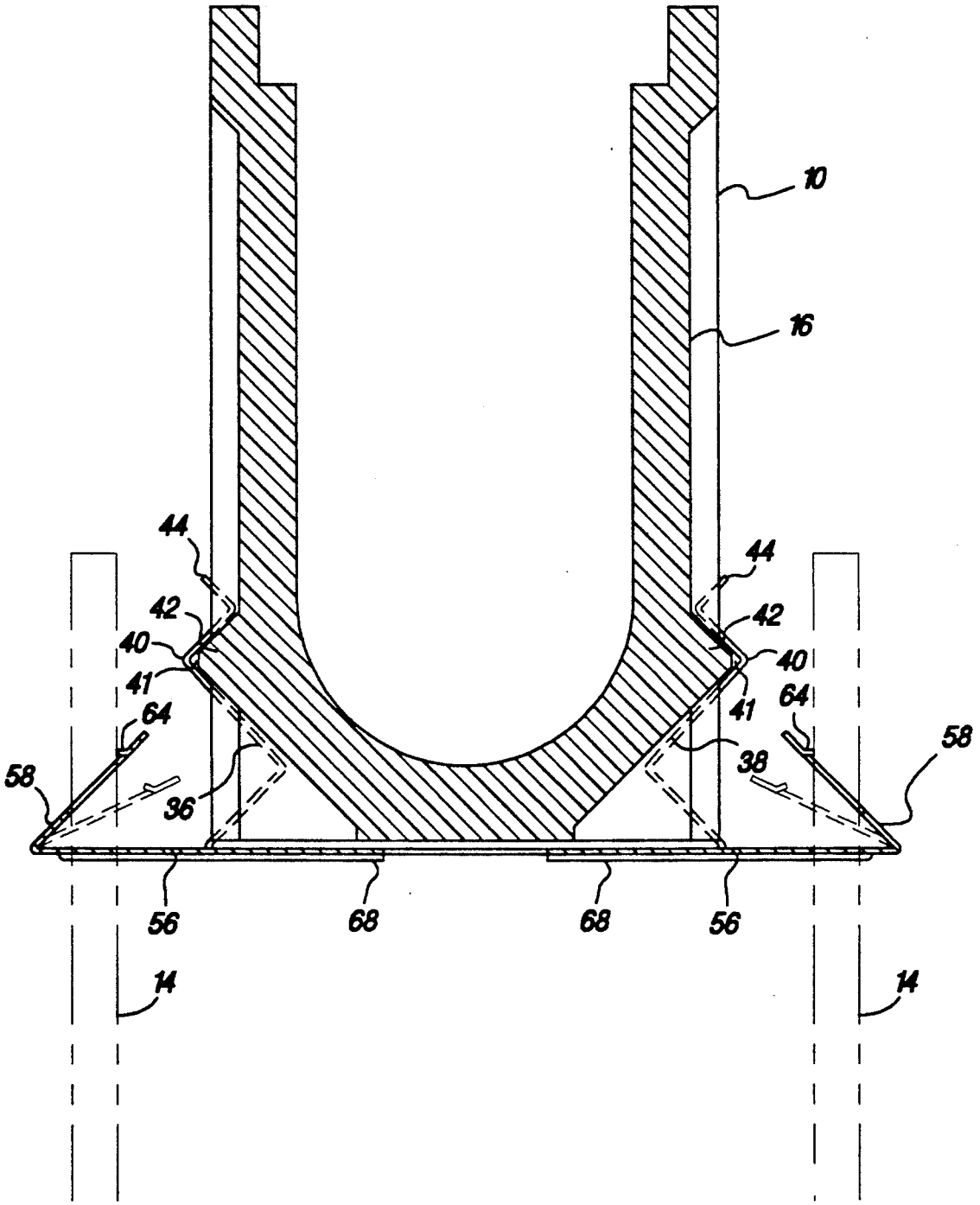
FIG. 6 is a sectional view of the clip as seen from the plane indicated by the line 6—6 of FIG. 3 supporting with support rods a drain channel section.
Figure 7:
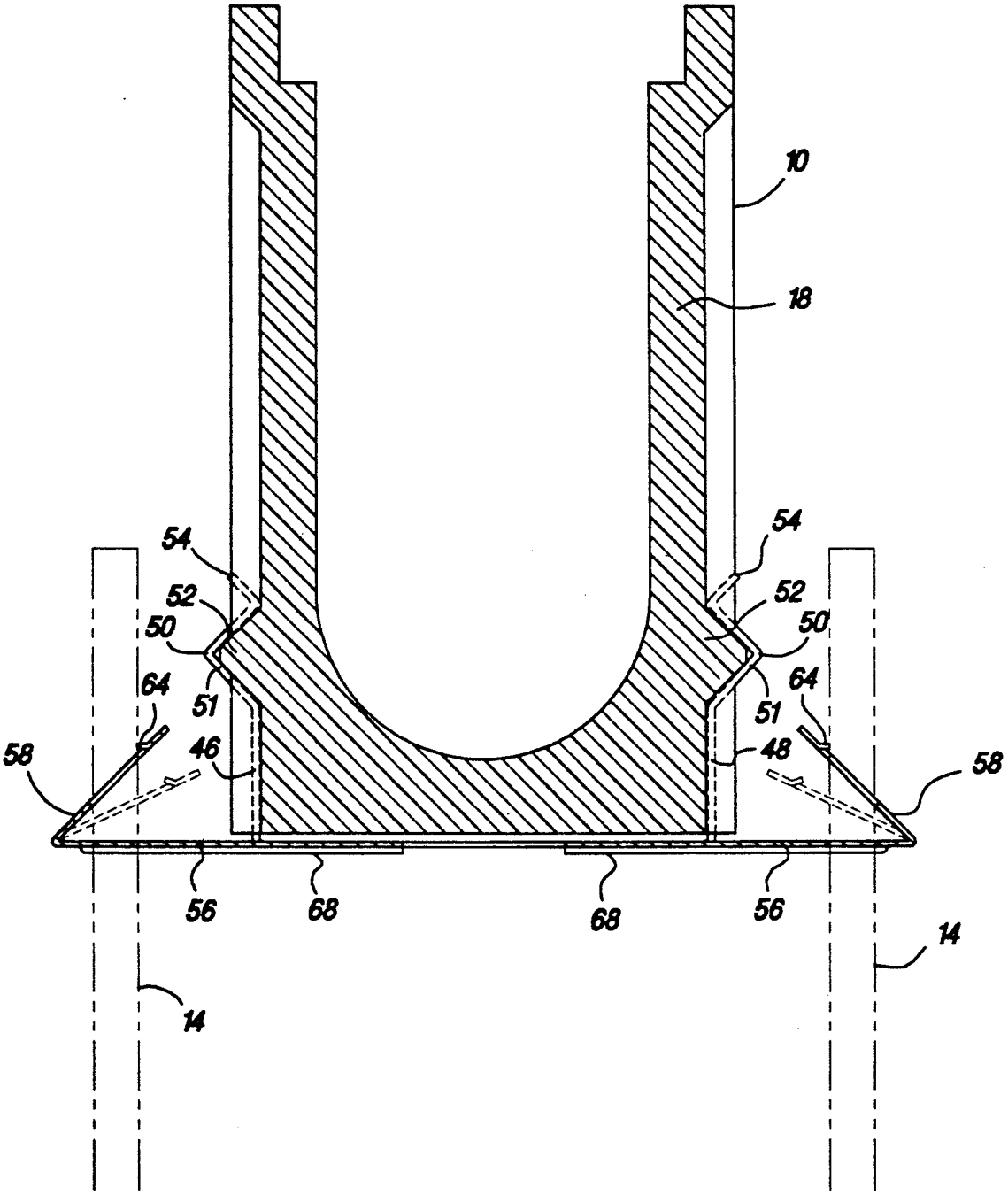
FIG. 7 is sectional view of the clip as seen from the plane indicated by the line 7—7 of FIG. 3 supporting with support rods a drain channel section.

As best understood from FIGS. 1, 6 and 7, the clip 12 is used to engage, clamp and support adjacent drain channel sections 10 of the trench drain system being installed in a ditch in the ground or floor. As seen in FIG. 6, a female end portion 16 of the drain channel section is mounted within the first clip structure 22. The female end portion 16 snaps into the first clip structure 22 between the upstanding support sections 36, 38. The support sections 36, 38 engage and clamp the female end portion 16 by conforming to the outer side surfaces of the female end portion 16. This allows the support sections 36, 38 to support the female end portion 16 at the outer side surfaces as opposed to the outer bottom surface which is spaced above the web 20.

As seen in FIG. 7, a male end portion 18 is mounted within the second clip structure 26. The male end portion 18 snaps into the second clip structure 26 between the upstanding support sections 46, 48. The support sections 46, 48 engage and clamp the male end portion 18 by conforming to the outer side surfaces of the male end portion 18. This allows the support sections 46, 48 to support the male end portion 18 at the outer side surfaces as opposed to the outer bottom surface which is spaced above the web 20.

The tabs 30, 32 engage vertical rods 14 through the apertures 60, 62. The rods 14 engage the bottom of the trench and may be embedded in the ground if the trench is located in soil. The rods 14 thereby hold the clip 12 and drain channel sections 10 above the ground. When the tabs 30, 32 are not deformed, the clip 12 is locked in vertical position on the rods due to the misalignment of the apertures 60, 62 and the spring pressure of the tab portions 56, 58. The lip 64 in aperture 62 helps each tab 30, 32 grip its corresponding rod 14.

When the tabs 30, 32 are deformed by compressing the tab portions 56, 58 together, as indicated in phantom in FIGS. 6 and 7, the apertures 60, 62 are aligned relative to the rods 14. The alignment of the apertures 60, 62 allows the clip 12 to be moved vertically relative to the rods 14 thereby permitting alignment of the adjacent drain channel sections 10 relative to each other and the trench drain system.

Once the clip 12 is positioned appropriately, concrete is poured into the trench. The concrete engages the drain channel sections while the clip holds the drain channel sections in position. The clip 12 prevents the drain channel sections from floating in the concrete.

Figure 8:
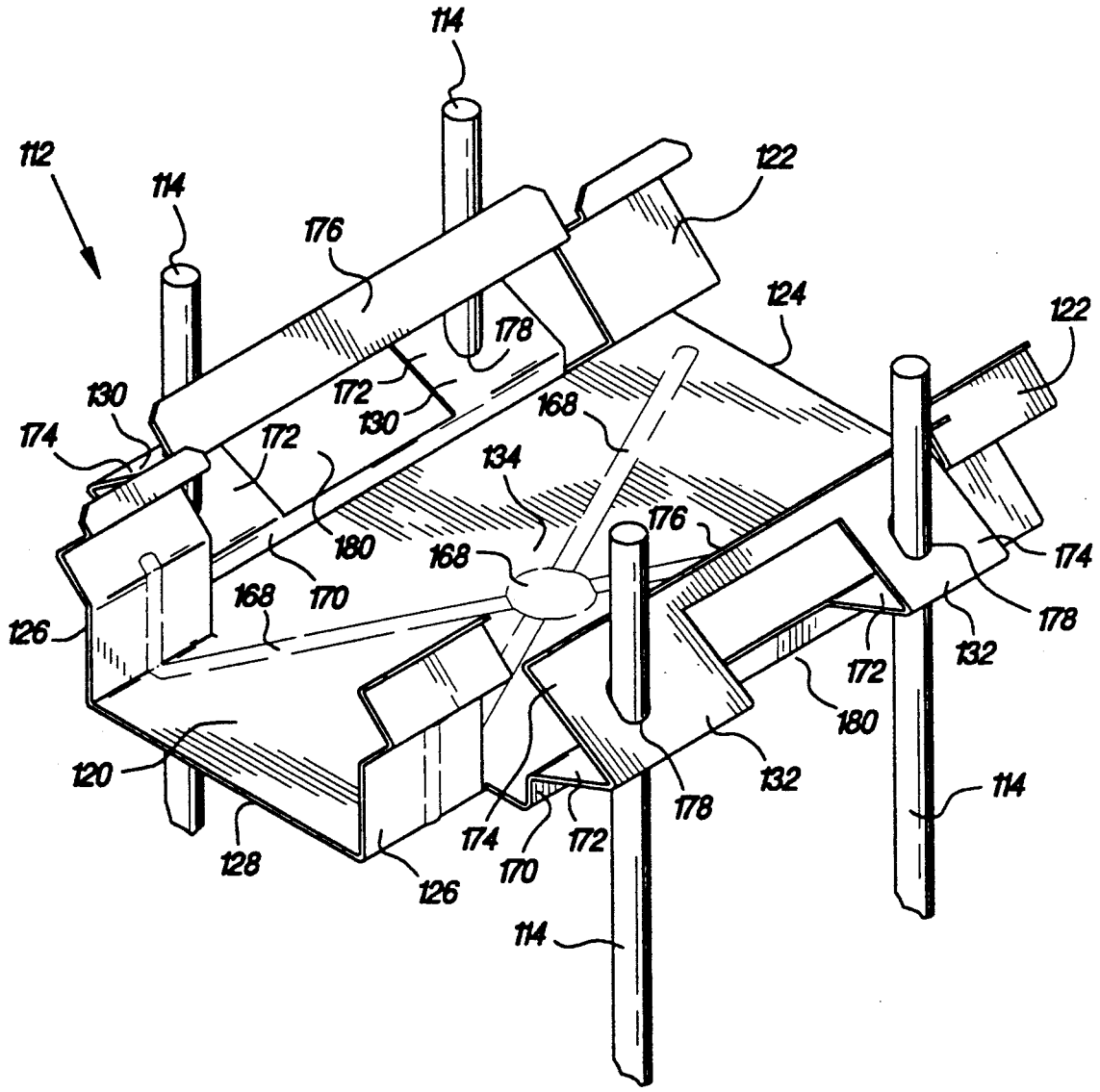
FIG. 8 is a perspective view of an alternative embodiment.

An alternative embodiment is illustrated in FIG. 8. The portions of the alternative embodiment which are substantially identical to those of the preferred embodiment have the same reference number plus one hundred.

A clip 112 has a first end portion 124 and an opposite end portion 128 substantially identical to the preferred embodiment. A web middle portion 134 has two pairs of tabs 130, 132, each located on opposite sides of a web 120. The tabs 130, 132 have parallel vertical portions 170. The tabs 130, 132 are then bent to form portions 172 and 174. The tab portion 174 is located over the tab portion 172. The tabs 130, 132 have tail portions 176 which diverge away from the tab portion 174.

The tab portions 172 and 174 have circular apertures 178 which are vertically misaligned relative to the web 120. Each tab receives and engages a support rod 114 through its apertures 178. The apertures 178 are slightly larger in diameter than the support rods.

Each pair of tabs 130, 132 are separated by a rectangular aperture 180. Each pair of tabs 130, 132 are connected by the vertical portions 170 and the tail portions 176.

The alternative embodiment of the clip 112 operates in the same manner as the preferred embodiment clip. By compressing the tab portions 172, 174 together and deforming the tabs 130, 132, the apertures 180 are aligned enough relative to a support rod 114 to allow the clip 112 to be moved vertically in order to properly align adjacent drain channel sections. Each tab within a pair must be compressed simultaneously in order to properly adjust the clip 112.

While the preferred embodiments of the invention have been described in detail, it will be understood that various modifications or alterations may be made therein without departing from the spirit and scope of the invention set forth in the appended claims.

We claim:

1. A one-piece apparatus for supporting and aligning two cooperating end portions of adjacent drain channel sections relative to a ground plane comprising:

a. a web;

b. a first clip means having two spaced resilient channel supports upstanding from opposite sides of a first web portion, the first slip means being configured to resiliently engage, clamp and support a first of the two cooperating end portions;

c. second resilient clip means being spaced and separate from the first clip means and having two spaced channel supports upstanding from opposite sides of a second web portion, the second clip means being configured to resiliently engage, clamp and support a second of the two cooperating end portions; and d. means structurally connecting and supporting the first and second clip means for aligning the drain channel sections, said connecting and supporting means comprising a third web portion connected to the first and second web portions and at least two deformable tabs, located on opposite sides of the third web portion, the tabs having at least two portions, a first of which is located over a second, each tab portion having an aperture that engages a support rod, wherein the first tab portion aperture is aligned vertically with the second tab portion aperture relative to the ground plane when the tab is deformed, wherein the tabs move along the rod when deformed and are locked in place with respect to the rod when not deformed.

2. The apparatus of claim 1 wherein the connecting means comprises two pairs of deformable tabs, each pair located on opposite sides of the third web portion.

3. The apparatus of claim 1 wherein the third web portion has a central aperture and at least two strengthening ribs extending within the third web portion and into the tabs.

4. A clip device for supporting and aligning two cooperating end portions of adjacent drain channel sections comprising:

a. a first portion including:

i. a substantially horizontal first web; and ii. two opposed upstanding support sections extending from opposite sides of the web, the support sections converging in substantially perpendicular planes, then diverging in substantially perpendicular planes, then converging in substantially perpendicular planes and then diverging in substantially perpendicular planes;

b. a second portion including:

i. a substantially horizontal second web; and ii. two opposed upstanding support sections extending from opposite sides of the web, the support sections proceeding equal distances from the web in substantially parallel planes, then diverging in substantially perpendicular planes, then converging in substantially perpendicular planes and then diverging in substantially perpendicular planes;

c. a third portion including:

i. a substantially horizontal third web connected to the first and second webs and having a central aperture;

ii. two deformable tabs, each located on opposite sides of the third web, the tabs having at least two portions, a first of which is located over a second, each tab portion having an aperture which engages a support rod, wherein the first tab portion aperture is aligned with the second tab portion aperture relative to the support rod when the tab is deformed, wherein the tabs move along the rod when deformed and are locked in place with respect to the rod when not deformed;

iii. two strengthening ribs extending within the third web.

5. The apparatus of claim 4 wherein the third portion comprises two pairs of deformable tabs, each located on opposite sides of the third web.

* * * * *